US008978909B2

(12) United States Patent
Kakutani et al.

(10) Patent No.: US 8,978,909 B2
(45) Date of Patent: Mar. 17, 2015

(54) CLOSURE DEVICE FOR A CONTAINER, AND SEAL MEMBER FOR THE DEVICE

(75) Inventors: Masahiro Kakutani, Osaka (JP); Norikazu Miyamoto, Osaka (JP); Tomohito Shirai, Osaka (JP); Katsushi Maeda, Kobe (JP); Eiji Yao, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 614 days.

(21) Appl. No.: 13/097,178

(22) Filed: Apr. 29, 2011

(65) Prior Publication Data

US 2011/0266249 A1 Nov. 3, 2011

(30) Foreign Application Priority Data

Apr. 30, 2010 (JP) ..... 2010-105547
Apr. 30, 2010 (JP) ..... 2010-105555

(51) Int. Cl.
*B65D 51/00* (2006.01)

(52) U.S. Cl.
CPC ..... *B65D 51/002* (2013.01)
USPC ..... 215/249; 215/247; 215/274; 215/296; 215/364; 220/320; 220/787; 220/790; 141/329

(58) Field of Classification Search
CPC ..... B65D 35/002
USPC ..... 215/249, 296, 364, 247, 274, DIG. 3; 141/329; 220/320, 787, 790
See application file for complete search history.

(56) References Cited

U.S. PATENT DOCUMENTS 4,205,754 A * 6/1980 Nielsen et al. ..... 215/249
4,366,912 A 1/1983 Matukura et al.

(Continued)

FOREIGN PATENT DOCUMENTS

EP 0794129 A1 9/1997
EP 1004287 * 7/1998 ..... A61J 1/00

(Continued)

OTHER PUBLICATIONS

Partial European Search Report dated Jun. 30, 2011 for Application No. 11003090.5.

(Continued)

*Primary Examiner* — Elizabeth Volz
(74) *Attorney, Agent, or Firm* — Birch, Stewart, Kolasch & Birch, LLP

(57) ABSTRACT

Disclosed is a closure device for a container, which seals an opening (6) that opens at the top of a container (2) and has a rim (7) on its periphery. The closure device comprises a seal member (8) that is to cover the opening (6) on the top of the container (2), and a synthetic resin cap (9) that is to press the seal member (8) against the upper surface of the rim (7). The seal member (8) comprises a flange (10) to be mounted on the upper surface of the rim (7). The cap (9) comprises a top wall (15), a cylinder part (16), and a locking part (18). The top wall (15) is to be disposed above the flange (10). The cylinder part (16) hangs down from the outer circumference of the top wall (15). The locking part (18) is disposed on the inner surface of the cylinder part (16). After the cap (9) is pushed down, the locking part (18) locks at the under surface of the rim (7). The upper surface of the flange (10) has a compressible projection (29). The compressible projection (29) is annularly arranged in contact with and along the outer circumference of the flange (10) in a planar view.

16 Claims, 10 Drawing Sheets

(56) References Cited

U.S. PATENT DOCUMENTS

| | | | | |
|---|---|---|---|---|
| 5,316,163 | A * | 5/1994 | von Schuckmann | 215/249 |
| 5,328,041 | A * | 7/1994 | Hook et al. | 215/247 |
| 5,718,348 | A * | 2/1998 | Manera | 215/249 |
| 2001/0002013 | A1 | 5/2001 | Claessens et al. | |

FOREIGN PATENT DOCUMENTS

| | | | |
|---|---|---|---|
| EP | 0922648 | A2 | 6/1999 |
| EP | 1004287 | A1 | 5/2000 |
| GB | 2071066 | A | 9/1981 |
| JP | 62-17545 | U | 2/1987 |
| JP | 7-165252 | A | 6/1995 |
| JP | 2001-245956 | A | 9/2001 |
| JP | 2003-128095 | A | 10/2003 |

OTHER PUBLICATIONS

European Search report dated Sep. 5, 2011 for Application No. 11003090.5.

* cited by examiner

CLOSURE DEVICE FOR A CONTAINER, AND SEAL MEMBER FOR THE DEVICE

TECHNICAL FIELD

The present invention relates to a closure device for sealing the opening of a container such as a vial, and to a seal member for the device.

BACKGROUND ART

A cylindrical vial having a closed bottom is used to contain medicines, various test reagents, or the like. The vial has an opening which opens at the top and through which the content is put in and taken out. Around the opening a rim is formed. The opening is conventionally sealed with a closure device that comprises, for example, an aluminum protector and a seal member. The protector has a wear part on the upper surface, and to the wear part a synthetic resin cap is affixed. The seal member fits into the inner surface of the protector and seals the opening.

A medicament contained in the vial is lyophilized as follows. The seal member is attached to the vial in a state in which a flange of the seal member is not in contact with the opening (hereafter referred to as an "incompletely sealing state"), and the vial is placed in a lyophilization apparatus. In the incompletely sealing state, the seal member does not seal the opening, and the inside of the vial containing the medicament communicates with the outside via the opening. By lyophilization in this state, liquid components in the medicament are frozen and then sublimated to be removed from the vial. After the completion of the lyophilization, the seal member is pushed down so as to seal the opening (hereinafter this state is referred to as a "sealing state"). Next, the sealed vial is taken out from the lyophilization apparatus, and the skirt of the protector is wound on the seal member with the use of a winding apparatus.

The vial having the aluminum protector is made of, as constituents, four kinds of materials, which are glass, aluminum, synthetic resin, and rubber. These materials are difficult to separate during disposal. In addition, although the vial taken out from a lyophilization apparatus is sealed with the seal member, whose leg has been inserted into the opening, the sealing performance is imperfect. In order to prevent the vial from being biologically contaminated with, for example, bacteria from the outside and to ensure liquid tightness and airtightness, it is necessary to completely seal the opening by winding a protector on the seal member with the use of a winding apparatus as soon as possible after the vial is taken out from the lyophilization apparatus.

As a conventional art for solving the above problems, there has been proposed a closure device for a container, comprising a synthetic resin cap provided with a cylinder part and with a top wall, and a seal member that is to be attached to the cap (see, for example, JP-07-165252-A).

In this conventional art, the top wall has a window for needle entry, and the cylinder part hangs down from the outer circumference of the top wall. On the inner surface of the cylinder part, a locking means is disposed. The seal member fits into the inside of the cap. The seal member comprises a disk-shaped flange and a cylindrical leg hanging down from the under surface of the flange.

The vial is placed in a lyophilization apparatus with its opening provided with the closure device in the incompletely sealing state. After the completion of the lyophilization, the vial is pressed down so that the closure device is pushed down to the sealing state. In this sealing state, the flange is firmly pressed against the periphery of the vial opening by the top wall of the cap. The locking means locks at the under surface of the rim of the vial, thereby holding the cap in a state in which the seal member is firmly pressed against the upper surface of the rim by the top wall.

Transition from the incompletely sealing state to the sealing state is achieved as follows: for example, in the lyophilization apparatus, the gaps between the shelves are narrowed, and the upper shelf presses down the vial so as to push down the closure device. When the pressing force is excessively high, the vial may be damaged. Accordingly, the pressing force is set at, for example, 60 N or less. However, size variations occur in, for example, the overall height of the vial, the thickness of the flange, the horizontal level of the shelves of the lyophilization apparatus, the gaps between the multiple shelves, or the like. The size tolerance of, for example, the thickness of the flange is set at ±0.3 mm.

Especially when the vial is made of glass, the size tolerance of the overall height of the vial is set at as large as ±0.5 mm. Consequently, it is difficult to securely cap a large number of (for example, 6000) vials at a time without failures by pushing down their closure devices to the sealing state by means of the shelves that move a certain distance. The top wall of the cap may fail to firmly press down the seal member, which may result in sealing failures or decrease in airtightness.

As a conventional seal member, there exists a seal member whose upper surface has a projection that is provided between the central part for injection needle insertion and the circumference of the flange. An object of providing this projection is to offer the following advantages, which are attributed to decrease in contact area between the seal member and other things:

(1) advantage of preventing the seal members from adhering to each other in a production step of the seal member, a filling step of a medicine, or the like;
(2) advantage of preventing the seal member from adhering to the wall of a facility device in a washing step, a sterilization step, a drying step, or the like;
(3) advantage of improving the operability of a parts feeder for the seal member;
(4) advantage of preventing the top of the seal member from adhering by suction to the under surface of the shelf that pushes down the seal member to the sealing state in a lyophilization apparatus, and consequently preventing the vial from being lifted and then tipped over or damaged; and the like.

However, even when the seal member having the projection is used to securely cap the vial, the flange may not be sufficiently pushed down by the cap, which may result in sealing failure. In addition, if the size of the projection and/or the thickness of the flange is larger, the pressing force required for capping is excessively high and thus it is difficult to securely cap all the vials with the seal members.

The content of the vial is taken out according to the following process. First, from the window for needle entry located in the center of the top wall, an injection needle is inserted into the vial through the center part of the upper surface of the seal member. Next, a dissolving solution or the like is injected into the vial through the needle, and the dissolved content is pumped out with the needle. Unless the flange is firmly pressed against the upper surface of the rim by the cap, the insertion force causes the center part of the seal member to be deformed toward the inside of the vial and, as a result, the insertion may fail. This tendency is greater especially when a larger injection needle, for example, a double-ended needle, a plastic infusion needle (diameter: about 4 mm), or the like is used. Moreover, when an injection needle is obliquely inserted into the vial through the seal member, whose leg hangs down into the opening of the vial, the tip of the injection needle may accidentally stick into the leg. Upon this oblique insertion, unless the flange is firmly pressed down by the cap as described above, further insertion of the needle may draw the flange into the vial along with the leg.

SUMMARY OF INVENTION

Technical Problem

An object of the present invention is to provide a simple closure device for a container, which ensures sealing of the opening of the container with a seal member despite size variations in the overall height of the container, the thickness of a flange of the seal member, or the like. Another object of the present invention is to provide a simple closure device for a container, which ensures insertion of an injection needle or the like into the container through a seal member when the insertion is needed.

Solution To Problem

In order to solve the above problems, the present invention provides a closure device having the following structure, for example, as shown in FIGS. 1 to 17B, which show embodiments of the invention.

The closure device seals an opening 6 that opens at the top of a container 2 and has a rim 7 on its periphery. The closure device comprises a seal member 8 that is to cover the opening 6, and a synthetic resin cap 9 that is to press and thereby hold the seal member 8 on the upper surface of the rim 7. The cap 9 comprises a top wall 15, a cylinder part 16, and a locking part 18. The top wall 15 is to be disposed above a flange 10 of the seal member 8, and the cylinder part 16 hangs down from the outer circumference of the top wall 15. The locking part 18 is disposed on the inner surface of the cylinder part 16. After the cap 9 is pushed down, the locking part 18 locks at the under surface of the rim 7. The seal member 8 comprises the flange 10 that is to be mounted on the upper surface of the rim 7. The upper surface of the flange 10 has a compressible projection 29 that projects upward. The compressible projection 29 is annularly arranged in contact with and along the outer circumference of the flange 10 in a planar view. The compressible projection is not limited to a particular size or shape, and may be formed into, for example, a continuous annular ring, a discontinuous annular ring, or the like.

The present invention also comprises a seal member having the following structure.

The seal member is used for the closure device 1. The seal member comprises a disk-shaped flange 10 and a leg 11 that hangs down from the under surface of the flange 10. The seal member also comprises a compressible projection 29 that projects upward from the upper surface of the flange 10. The compressible projection 29 is annularly arranged in contact with and along the outer circumference of the flange 10 in a planar view.

The present invention exerts the following functions and effects.

Pushing down the closure device causes the top wall to push down the seal member, and then the leg of the seal member is fully inserted into the container. In this sealing state, the flange is pressed against the upper surface around the opening of a container by the top wall. When the closure device in the incompletely sealing state is pushed down, first the top wall presses down the compressible projection, and then presses down part of the flange just under the compressible projection. After the compressible projection is flattened, the top wall presses down the other part of the flange. That is, via the compressible projection that is pressed and thereby compressed, the flange just under the compressible projection is pressed against the upper surface of the rim around the opening of the container. Since the compressible projection is annularly arranged along the outer circumference of the flange, the downward pressing force through the compressible projection presses part of the flange just under the compressible projection against the upper surface of the rim and, as a result, the opening is sealed.

Only the compressible projection along the circumference of the flange is provided on the upper surface of the flange, yet this simple structure is sufficient to ensure sealing of the opening. Since the compressible projection is provided only in part of the upper surface of the flange, the force necessary for pressing down the compressible projection is smaller than the force necessary for pressing down the entire flange. Therefore, a small pressing force, for example, 50 N or less, preferably about 30 N or less per vial is sufficient to ensure capping of the opening. Moreover, the compression of the compressible projection absorbs each size variation occurring within the tolerance, thereby decreasing sealing failures and improving the airtightness.

Once the closure device is attached in the sealing state to a container, such as a vial, containing a lyophilized preparation, a powder preparation, a liquid preparation, or the like, the opening of the container is securely sealed by the seal member; thus the inside of the container is completely shut off from the outside and is free from biological contamination, and the liquid tightness and airtightness of the container are maintained.

The compressible projection is in contact with the outer circumference of the flange in a planar view and thus the flange's upper surface surrounded by the outer circumference of the compressible projection is most extensive. When the vial is capped by means of the shelf of a lyophilization apparatus or the like, the pressing force through the top wall received by the compressible projection is evenly distributed to the extensive surface. This structure enables the top wall to uniformly press down the flange, and consequently the upper surface of the seal member is stably kept horizontal. Thus the seal member is set onto the opening of the vial in a proper state.

The height of the lateral surface of the flange is increased in the vertical direction by the height of the compressible projection formed on the outer circumference of the flange. When the seal member is attached to the opening of a container in the incompletely sealing state, the flange is not in contact with the top of the container. To the seal member in this state, the cap, whose cylinder part is guided by the lateral surface having the increased height, is attached. Consequently, the cap is attached to the seal member in a proper state in which the central axis of the cylinder part is vertical.

The present invention also comprises the following closure device for a container.

As shown in, for example, FIGS. 1 to 17B, the closure device seals an opening 6 that opens at the top of a container 2 and has a rim 7 on its periphery. The closure device comprises a seal member 8 that is to cover the opening 6 and has rubber elasticity, and a synthetic resin cap 9 that is to press and thereby hold the seal member 8 on the upper surface of the rim 7. The seal member 8 comprises a flange 10 to be mounted on the upper surface of the rim 7. The cap 9 comprises a top wall 15, a cylinder part 16, and a locking part 18. The top wall 15 is to be disposed above the flange 10. The cylinder part 16 hangs down from the outer circumference of the top wall 15.

The locking part 18 is disposed on the inner surface of the cylinder part 16. After the cap 9 is pushed down, the locking part 18 locks at the under surface of the rim 7. A receiving projection 27 projects downward from an annular part on the under surface of the top wall 15, the annular part having an inner diameter that is larger than that of the opening 6 and an outer diameter that is smaller than that of the flange 10.

The present invention exerts the following functions and effects.

In the sealing state, the flange is pressed against the upper surface around the opening by the top wall, and the receiving projection bites into the upper surface of the flange. Only the receiving projection is provided on the under surface of the cap, yet this simple structure is sufficient to prevent the flange from moving radially inward and to firmly hold the flange between the top wall of the cap and the upper surface of the container.

The above structure also prevents the seal member from being deformed toward the inside of the container by the insertion force of an injection needle or the like that is inserted through the center of the seal member in order to take out the content of the container. Even when the tip of the injection needle accidentally sticks into the leg of the seal member, the flange is prevented from being drawn into the container along with the leg. Thus the structure ensures insertion of the injection needle or the like into the container through the seal member.

The present invention also comprises the following closure device for a container.

As shown in, for example, FIGS. 6 to 8 or FIGS. 14A to 17B, the compressible projection 29 is formed into a discontinuous annular ring that is arranged along the outer circumference of the flange 10. In this embodiment, the space surrounded by the compressible projection communicates with the outside via discontinuous parts. Upon the attachment of the seal member to a container in the incompletely sealing state, or during handling before the attachment, this structure prevents the top of the seal member surrounded by the compressible projection from adhering by suction to attaching means, a handling device, various kinds of processing apparatuses, or the like, as if the seal member were a sucking disk.

The present invention also comprises the following closure device for a container.

As shown in, for example, FIGS. 14A and 14B, a plurality of the compressible projections 29 are arranged along the outer circumference of the flange 10, and each of the compressible projections extends radially inward from the outer circumference of the flange 10. In this embodiment, when the compressible projections are pressed by the top wall, the flange 10 under the compressible projections 29 is extensively pressed against the rim around the opening. Consequently, the opening is more securely sealed by the seal member.

The present invention also comprises the following closure device for a container.

The closure device comprises the compressible projection 29 that projects upward from the upper surface of the flange 10, and the receiving projection 27 that projects downward from the under surface of the top wall 15, wherein at least part of the compressible projection 29 is positioned radially outward relative to the receiving projection 27. In this embodiment, the receiving projection receives the compressible projection and prevents the flange from moving radially inward. Consequently, even when atmospheric pressure acts on the center of the seal member, this structure prevents the edge of the flange from moving or becoming thinner, decreases sealing failures, and improves the airtightness. In addition, the flange is firmly held between the top wall of the cap and the upper surface of the container, and thus an injection needle or the like is reliably inserted into the container through the seal member when the insertion is needed.

The present invention also comprises the following closure device for a container.

As shown in, for example, FIGS. 1, 2, 4, and 5, the receiving projection 27 is an annular ring that surrounds the opening 6 in a planar view. This embodiment ensures that the receiving projection receives the compressible projection throughout the whole circumference of the opening. The annular ring that surrounds the opening may be discontinuous in the circumference direction. However, the receiving projection is more preferably a continuous annular ring that is arranged along the circumference because the continuous annular ring can more effectively prevent the flange from moving radially inward. The present invention also comprises the following closure device for a container.

As shown in, for example, FIGS. 7 and 8, the height h of the compressible projection 29 is 10 to 60% of the thickness t of the flange 10 excluding the compressible projection 29.

In this embodiment, the compression of the compressible projection effectively absorbs each size variation occurring within the tolerance, and therefore a small pressing force is sufficient to ensure sealing of the opening with the seal member. The height of the compressible projection is more preferably 20 to 50% of the thickness of the flange.

The present invention also comprises the following closure device for a container.

As shown in, for example, FIGS. 1, 2, 4, 5, and 9, in a vertical section that passes through the center axis of the opening 6, the lower edge of the receiving projection 27 has an angle of 90 degrees or less. In this embodiment, the receiving projection is intended to reliably bite into the upper surface of the flange. The angle of the lower edge is preferably set at 70 degrees or less. If the sectional shape of the lower edge is excessively sharp, the lower edge may damage the surface of the seal member and/or the strength of the receiving projection may decrease. Accordingly, the angle of the lower edge is more preferably set at 20 to 65 degrees. In addition, the lower edge is preferably chamfered into, for example, a rounded shape having a radius of about 0.05 mm.

The present invention also comprises the following closure device for a container.

As shown in, for example, FIG. 9, in a vertical section that passes through the center axis of the opening 6, the receiving projection 27 has a sharp angle $\alpha$ of 45 degrees or less between the surface facing radially outward and the vertical line. In this embodiment, the receiving projection reliably receives the flange against the insertion force of an injection needle or the like, thereby preventing the center part of the flange from being deformed toward the inside of a container. The sharp angle more preferably has an angle of about zero degrees, i.e., the surface facing radially outward of the receiving projection 27 more preferably stands vertically.

The present invention also comprises the following closure device for a container.

As shown in, for example, FIG. 5, the height L of the receiving projection 27 is 0.3 to 2.0 mm. In this embodiment, the receiving projection having a height of 0.3 mm or more reliably receives the flange against the insertion force of an injection needle or the like, thereby preventing the center part of the flange from being deformed toward the inside of a container. Moreover, there is no risk that the receiving projection having a height of 2.0 mm or less would damage the surface of the seal member.

The present invention also comprises the following closure device for a container.

The seal member 8 is made of at least one of a synthetic rubber material and a thermoplastic elastomer. This embodiment enables the production of the seal member having excellent seal performance with stable quality.

The content of the container is not limited to a particular thing, and the content may be, for example, a powder preparation, a liquid preparation, or the like. However, the content is preferably a lyophilized preparation because the closure device has an advantage of, in the incompletely sealing state, being easily pushed down to the sealing state in a lyophilization apparatus.

BRIEF DESCRIPTION OF THE DRAWINGS

FIG. 11A is a plan view of the seal member, and FIG. 11B is a vertical sectional view of the seal member.

FIG. 12A is a plan view of the seal member, and FIG. 12B is a vertical sectional view of the seal member.

FIG. 13A is a plan view of the seal member, and FIG. 13B is a vertical sectional view of the seal member.

FIG. 14A is a plan view of the seal member, and FIG. 14B is a vertical sectional view of the seal member.

FIG. 15A is a plan view of the seal member, and FIG. 15B is a partial fragmentary view of the seal member.

FIG. 16A is a plan view of the seal member, and FIG. 16B is a vertical sectional view of the seal member.

FIG. 17A is a plan view of the seal member, and FIG. 17B is a vertical section of the seal member.

DESCRIPTION OF EMBODIMENTS

Embodiments of the present invention will be described below in more details with reference to the drawings.

Figure 1:
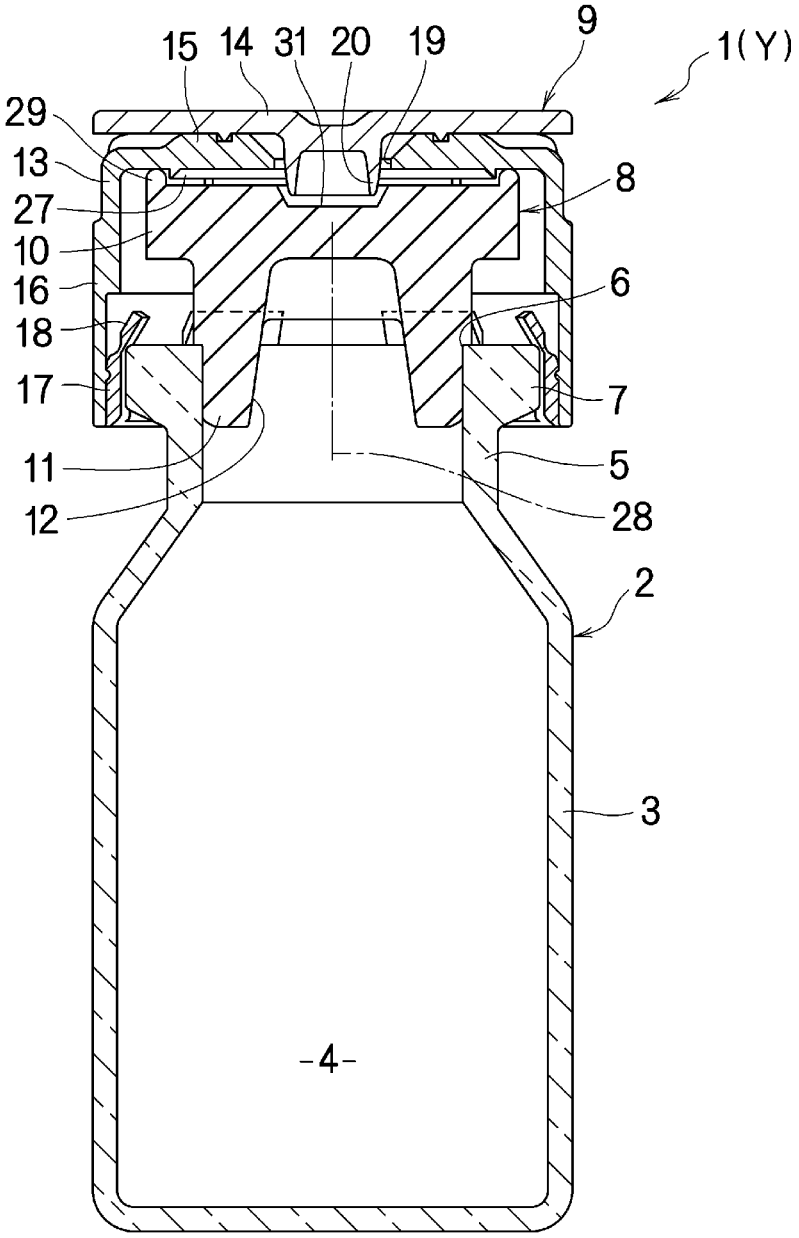
FIG. 1 is a vertical sectional view of the vial to which the closure device is attached in the incompletely sealing state, showing an embodiment of the present invention.

FIGS. 1 to 8 show embodiments of the present invention. FIG. 1 is a vertical sectional view of a vial 2 (a container) to which the closure device 1 is attached in the incompletely sealing state Y. The vial 2 comprises a cylindrical trunk 3 with a bottom, and the trunk 3 has a storage part 4. The storage part 4 can contain contents such as a medicine. The upper part of the trunk 3 extends to a neck 5. The top of the neck 5 has an opening 6. The periphery of the opening 6 is formed into a rim 7 that swells radially outward.

The closure device 1 comprises a seal member 8 and a cap 9. The seal member 8 is to cover the opening 6 and made of a synthetic rubber having rubber elasticity, for example, a butyl rubber. The cap 9 is to cover the seal member 8 and made of a synthetic resin.

The seal member 8 comprises a flange 10 and a leg 11. The flange 10 is shaped like a disk and is to be mounted on the upper surface of the rim 7. The leg 11 is shaped like a cylinder that hangs down from the radially intermediate part of the under surface of the flange 10. The leg 11 has a notch 12 extending from the bottom of the leg 11 to the middle part of the seal member in the vertical direction. The top of the notch 12 is to be positioned above the opening 6 in the incompletely sealing state Y as shown in FIG. 1. The inside of the storage part 4 communicates with the outside of the vial 2 via the opening 6 and the notch 12. The outer diameter of the leg 11 is slightly larger than the inner diameter of the opening 6 and thus, when the leg 11 is inserted into the opening 6, the leg 11 is slightly compressed.

The cap 9 comprises a cap body 13 and a lid 14 that is fixed on the top of the cap body 13. The cap body 13 comprises a top wall 15, a cylinder part 16, and an annular locking member 17. The top wall 15 is to be disposed above the flange 10. The cylinder part 16 hangs down from the outer circumference of the top wall 15. The locking member 17 is attached to the inner surface of the cylinder part 16. On the top of the locking member 17, a locking part 18 is formed. In the center of the top wall 15, a window for needle entry 19 opens. From the center of the under surface of the lid 14, a cylindrical sealer 20 hangs down, passing through the window for needle entry 19.

Figure 2:
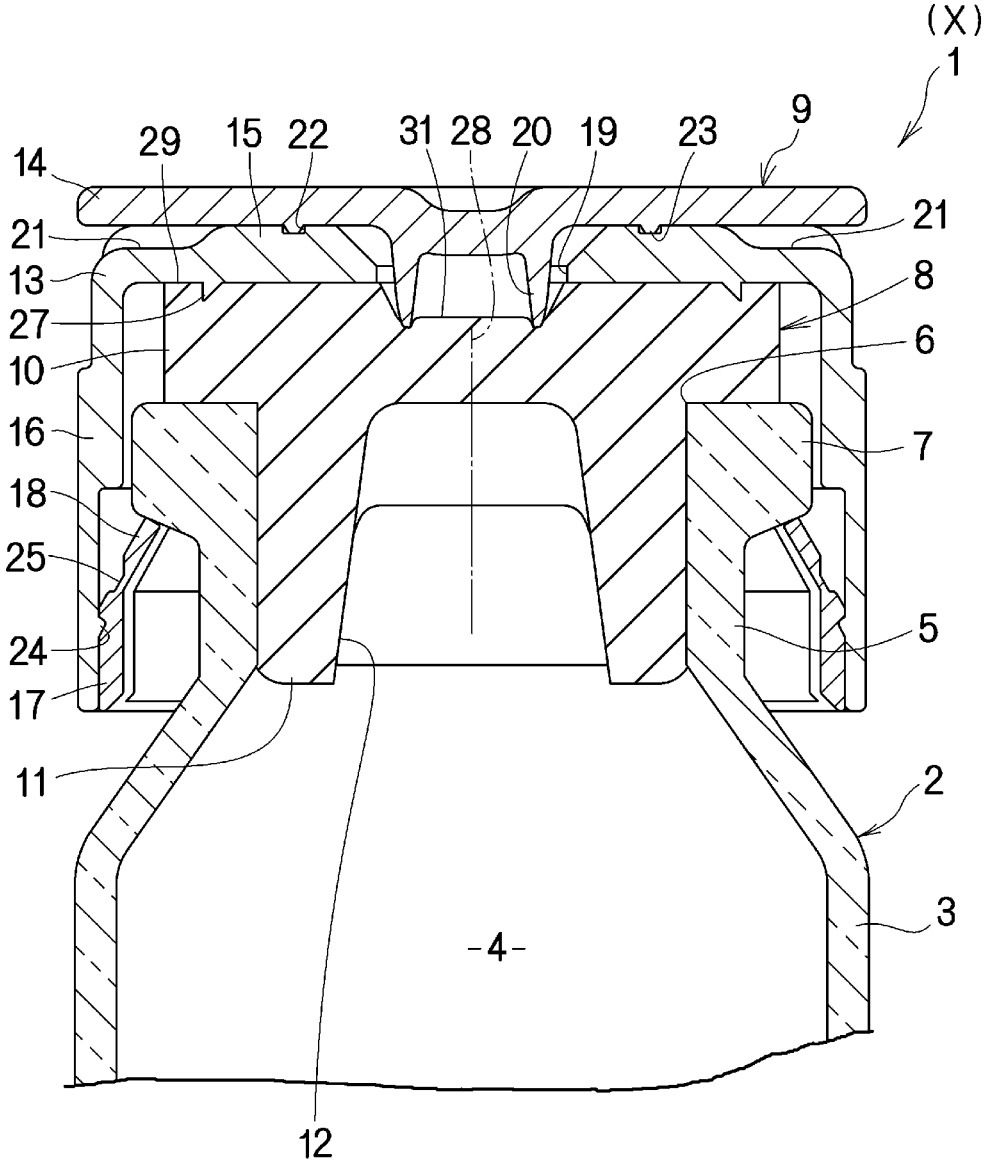
FIG. 2 is a sectional view of the closure device in the sealing state in an embodiment of the present invention.

After the content of the vial 2 is lyophilized, the vial is pressed down from the above so that the closure device 1 is pushed down to the sealing state X as shown in FIG. 2. In the sealing state X, the flange 10 is firmly pressed against the upper surface around the opening 6 by the top wall 15, and thereby the opening 6 is sealed. In this state, the locking part 18 locks at the under surface of the rim 7 of the vial 2, thereby holding the cap 9 in the sealing state X. The bottom of the sealer 20 bites into the upper surface of the seal member 8, and consequently the space above the center of the upper surface of the seal member 8 is airtightly shut off from the outside.

Figure 3:
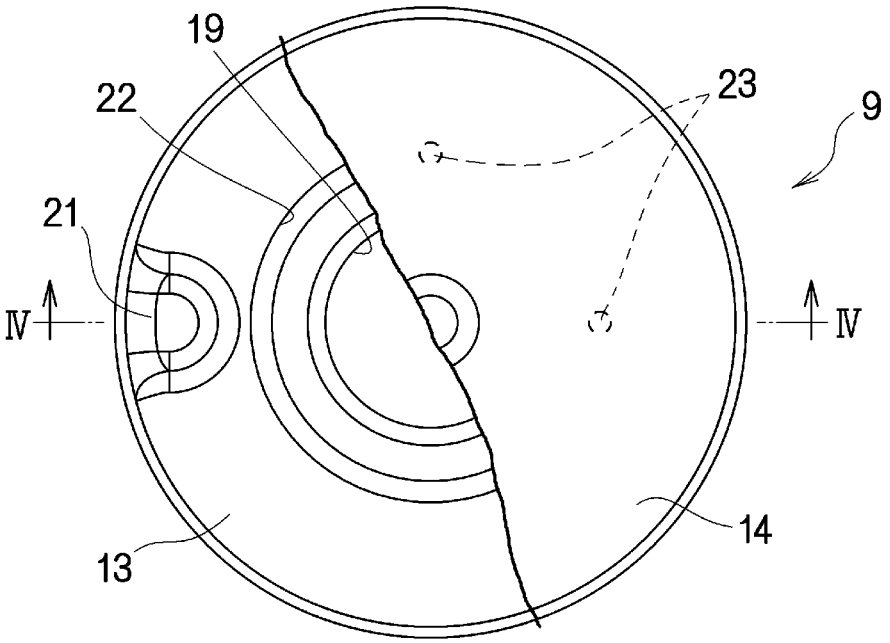
FIG. 3 is a partial fragmentary plan view of the cap in an embodiment of the present invention.
Figure 4:
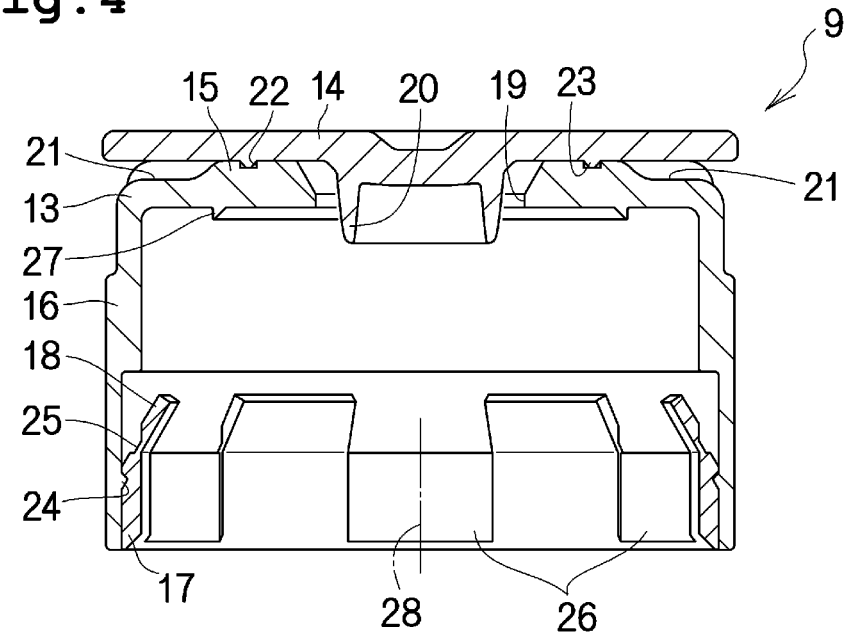
FIG. 4 is a sectional view of FIG. 3 taken along the line IV-IV.

As shown in FIGS. 3 and 4, on the upper surface of the cap body 13 formed are two depressions 21 as gates for injection molding, and an annular groove 22 surrounding the window for needle entry 19. On the under surface of the lid 14, four joining projections 23 stick out. The bottoms of the joining projections 23 are welded onto the inner surface of the groove 22, so that the lid 14 is fixed onto the upper surface of the cap body 13.

As shown in FIG. 4, a fitting ridge 24 that is annularly formed on the inner surface of the cylinder part 16 fits into the locking member 17. On the locking member 17, at predetermined intervals a plurality of locking parts 18 stick out obliquely upward and radially inward. Each of the locking parts 18 has a hinge 25 at the base. The upper part can be inclined radially outward. On the inner surface of the above locking member 17, ventilation openings 26 are provided between each locking part 18 in a planar view. In the incompletely sealing state Y as shown in FIG. 1, the storage part 4 communicates with the outside via the opening 6, the notch 12, and then the ventilation openings 26.

Figure 5:
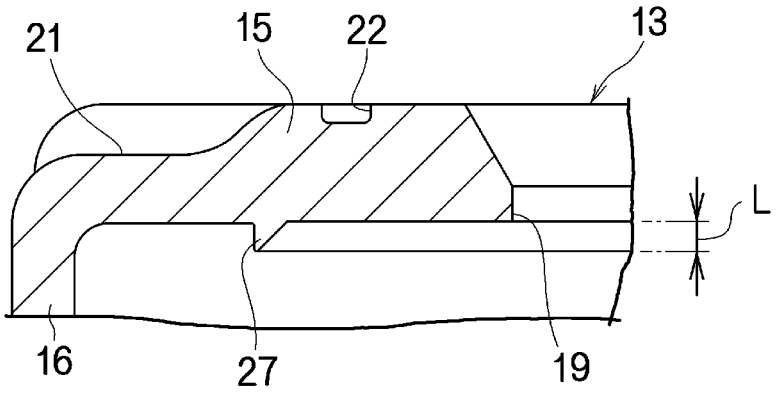
FIG. 5 is an enlarged sectional view of the principal part of the cap body in an embodiment of the present invention.

As shown in FIGS. 2 and 4, the under surface of the top wall 15 of the cap body 13 has a receiving projection 27. The receiving projection 27 projects downward from the top wall's annular part whose inner diameter is larger than that of the opening 6 and whose outer diameter is smaller than that of the flange 10. The receiving projection 27 is a continuous annular ring that surrounds the opening 6 in a planar view. FIG. 5 shows a vertical section of the receiving projection 27. The vertical section passes through the central axis 28 of the opening 6. The sectional shape of the lower edge of the receiving projection 27 is formed to have an angle of 90 degrees or less, for example, 45 degrees. In this vertical section, the surface facing radially outward of the receiving projection 27 stands vertically along the central axis 28. The height L of the receiving projection 27 is set at, for example, 0.5 mm.

Figure 6:
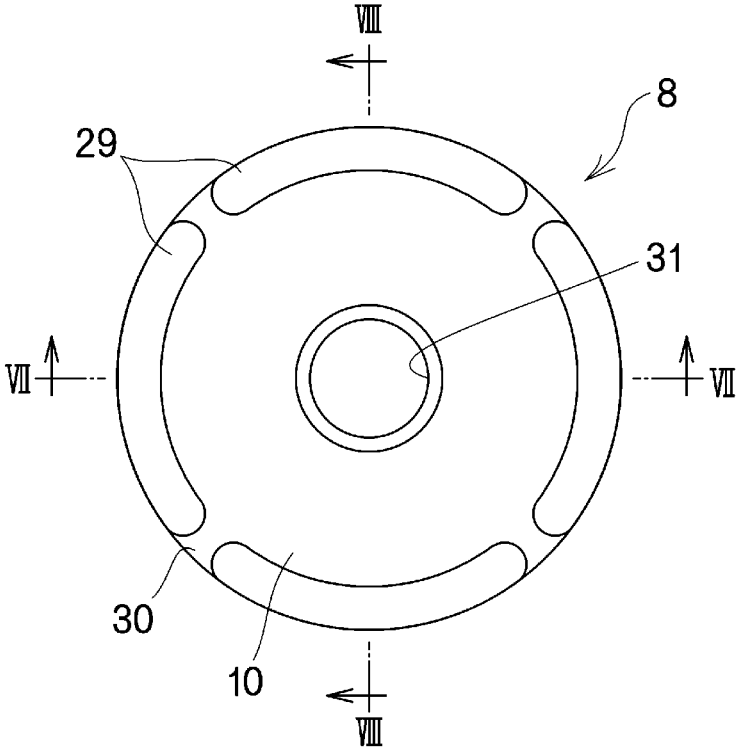
FIG. 6 is a plan view of the seal member in an embodiment of the present invention.
Figure 7:
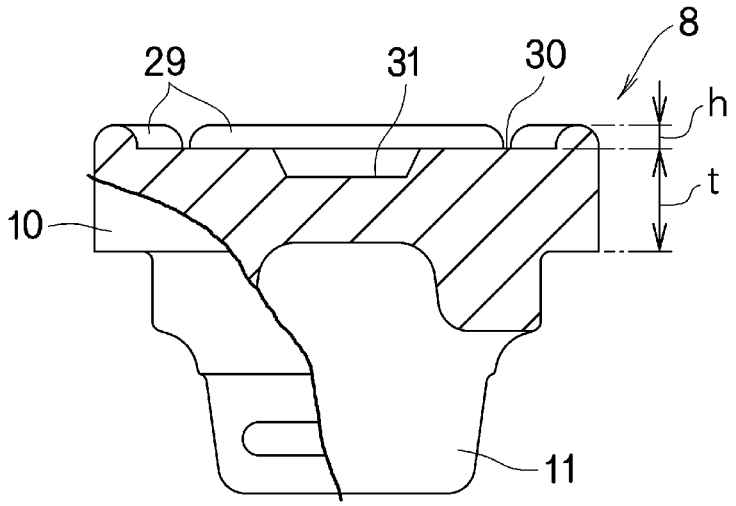
FIG. 7 is a sectional view of FIG. 6 taken along the line VII-VII.
Figure 8:
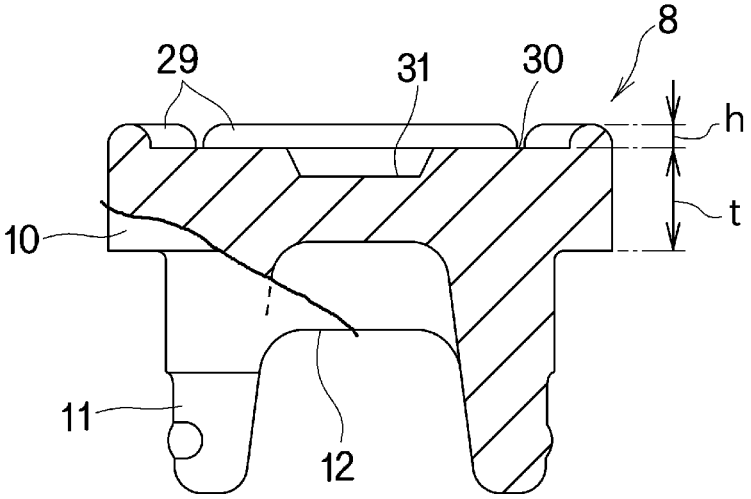
FIG. 8 is a sectional view of FIG. 6 taken along the line VIII-VIII.

The seal member 8 has a compressible projection 29 on the upper surface of the flange 10. As shown in FIGS. 6 to 8, in a planar view, the compressible projection 29 is annularly arranged in contact with and along the outer circumference of the flange 10. Consequently, the height of the lateral surface of the flange 10 is increased in the vertical direction by the height of the compressible projection 29, as shown in, for example, FIGS. 7 and 8. The cap 9 and the seal member 8 are to be attached to the vial 2 in the incompletely sealing state Y as shown in FIG. 1 as follows: first the seal member 8 is attached to the opening 6, and then the cap 9, whose cylinder part 16 is guided by the lateral surface having the increased height, is attached to the seal member 8 in a proper state in which the central axis of the cylinder part 16 is vertical.

The compressible projection 29 has four discontinuous parts 30 in the circumference direction, and the space surrounded by the compressible projection 29 communicates with the outside via these discontinuous parts 30. This structure can effectively prevent the seal member 8 from adhering by suction to attaching means, a handling device, various kinds of processing apparatuses, or the like, as if the seal member were a sucking disk, upon the attachment of the seal member 8 to the vial 2 in the incompletely sealing state Y, or during processing before the attachment, such as handling, washing, and sterilization. In addition, a depression for needle insertion 31 is provided on the center of the upper surface of the flange 10. In the present invention, instead of the four discontinuous parts 30 provided on the compressible projection 29 in the circumference direction, three or less, or five or more discontinuous parts may be provided in the circumference direction.

As shown in FIG. 1, the receiving projection 27 is positioned radially inward relative to the compressible projection 29. The receiving projection 27 is intended to receive the compressible projection 29 in order to prevent the seal member 8 from moving radially inward or being deformed. The height h of the compressible projection 29 is set at, for example, 0.8 mm. When the thickness t of the flange 10 excluding the compressible projection 29 is, for example, 3.5 mm, this height is set at about 23%.

The closure device 1 is to be attached to the vial 2 in the incompletely sealing state Y as shown in FIG. 1. The vial 2 is placed in a lyophilization apparatus (not shown), and the content of the vial 2 is lyophilized under reduced pressure. Next, the vial 2 is pressed down from the above by a shelf of the lyophilization apparatus so that the closure device 1 on the vial 2 is pushed down to the sealing state X as shown in FIG. 2. On this pressing, first the top wall 15 of the cap body 13 presses down the compressible projection 29 of the seal member 8, and then presses down part of the flange 10 just under the compressible projection 29. After the compressible projection 29 is flattened, the top wall 15 presses down the other part of the flange 10. After the completion of these pressing, the receiving projection 27 bites into the upper surface of the flange 10 as shown in FIG. 2, and the flange 10 is consequently firmly held between the top wall 15 of the cap 9 and the upper surface of the vial 2 and prevented from moving radially inward.

The compressible projection 29 is merely part of the entire flange 10, and consequently the compressible projection 29 is easily pressed down with a small pressing force. Via the compressible projection 29, the flange 10 under the compressible projection 29 is pressed against the upper surface around the opening 6 of the vial 2. Since the compressible projection 29 is annularly arranged along the outer circumference of the flange 10, the downward pressing force through the compressible projection 29 presses part of the flange 10 just under the compressible projection against the upper surface of the vial 2 and, as a result, the opening 6 of the vial 2 is sealed from the outside. The height of the compressible projection 29 is set so as to sufficiently absorb each size variation occurring within the tolerance. Owing to the height, even a small pressing force, for example about 30 N per vial, is sufficient to ensure capping of the opening 6 of the vial 2.

The compressible projection 29 is in contact with the outer circumference of the flange 10 in a planar view and thus the flange 10's upper surface surrounded by the outer circumference of the compressible projection 29 is most extensive; thus pressing force through the cap 9 is evenly distributed and the flange 10 is pressed down uniformly. Moreover, when pressed down by the top wall 15 of the cap 9, the upper surface of the seal member 8 is stably kept in horizontal and the seal member 8 is set onto the opening 6 in a proper state.

The content of the vial 2 that is sealed with the closure device 1 is taken out as needed according to the following process.

First, the lid 14 of the cap 9 is removed from the cap body 13 by breaking the joining projections 23, and the depression for needle insertion 31 on the seal member 8 is exposed to the outside through the window for needle entry 19. Next, an injection needle is inserted into the vial through the depression for needle insertion 31 in order to inject a dissolving solution or the like for reconstituting the content of the storage part 4 of the vial 2. The content is then pumped out with the injection needle.

When the injection needle is inserted into the vial 2 through the depression for needle insertion 31, the structure having the receiving projection 27 that bites into the upper surface of the flange 10 and the receiving projection 27 that receives the compressible projection 29 prevents the flange 10 from moving radially inward. This structure also prevents the seal member 8 from being deformed toward the inside of the vial 2. Further, even when the tip of the injection needle accidentally sticks into the leg, the structure prevents the flange 10 from being drawn into the vial 2 along with the leg. Thus the structure ensures smooth insertion of the injection needle into the vial 2 through the seal member 8.

In the above embodiment, the receiving projection 27 has a sectional shape whose surface facing radially outward stands vertically along the central axis 28 of the opening 6. However, the sectional shape of the receiving projection of the present invention is not limited to a particular shape.

Figure 9:
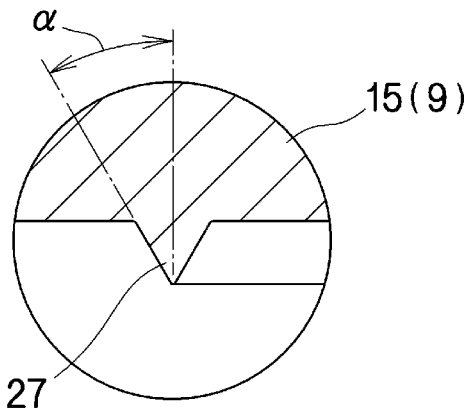
FIG. 9 is an enlarged sectional view of the principal part of the cap, showing Modified Example 1 of an embodiment of the present invention.

For example, as shown in Modified Example 1 in FIG. 9, in the vertical section passing through the central axis of the opening, the angle of the lower edge of the receiving projection 27 is set at about 60 degrees. The sharp angle ($\alpha$) between the surface facing radially outward and the vertical line is set at 45 degrees or less, for example, 30 degrees.

Figure 10:
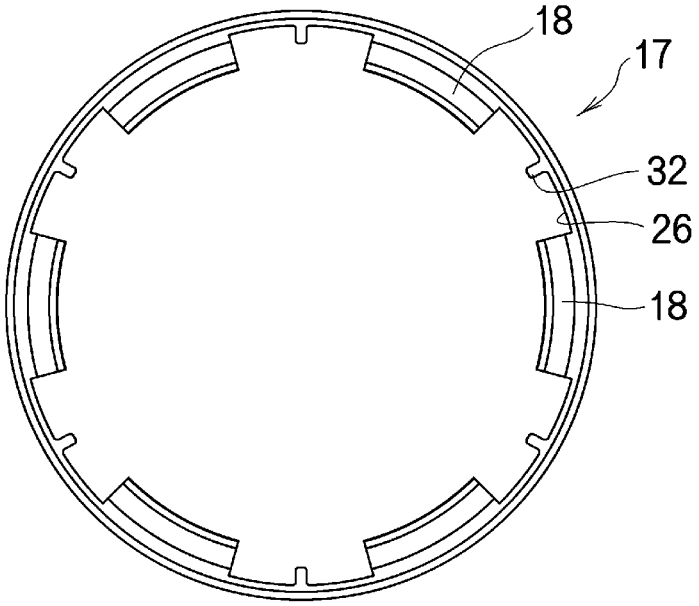
FIG. 10 is a plan view of the locking member, showing Modified Example 2 of an embodiment of the present invention.

FIG. 10 shows Modified Example 2 of an embodiment of the present invention. On the inner surface of the locking member 17, a stabilizer 32 is provided in each of the ventilation openings 26 that are longitudinally provided between each locking part 18. The diameter of a virtual circle that passes through the inner edges of each stabilizer 32 is set at about the same as the outer diameter of the rim 7 of the vial 2, or slightly smaller than the outer diameter of the rim 7; thus the cap having said locking member 17 is to be attached to the vial in a proper incompletely sealing state Y, in which the central axis of the cylinder part 16 corresponds with the central axis 28 of the opening 6 of the vial 2.

The compressible projection 29 on the seal member 8 can be formed into various shapes as needed, for example, as shown in Modified Examples in FIGS. 11A to 17B.

Figure 11A:
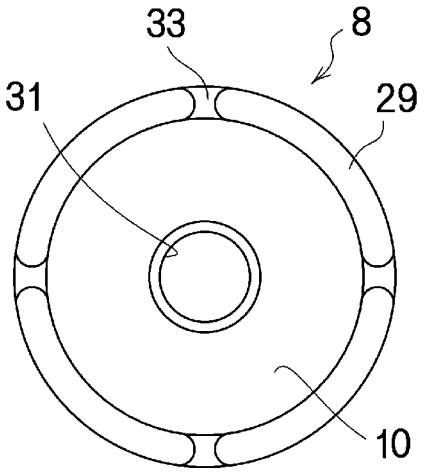
FIGS. 11A and 11B show Modified example 3 of an embodiment of the present invention.
Figure 11B:
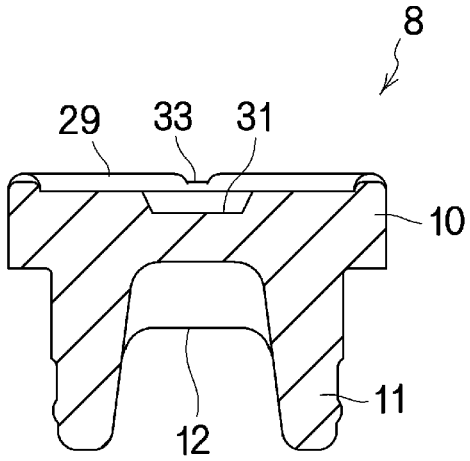

In Modified Example 3 in FIGS. 11A and 11B, the compressible projection 29 is formed into a continuous annular ring not having any gaps. This compressible projection 29 has a plurality of lower parts 33, whose heights are lower than that of the annular ring. The lower parts 33 allow the space surrounded by the compressible projection 29 to communicate with the outside, and thus prevent the seal member 8 from adhering by suction to other things.

Figure 12A:
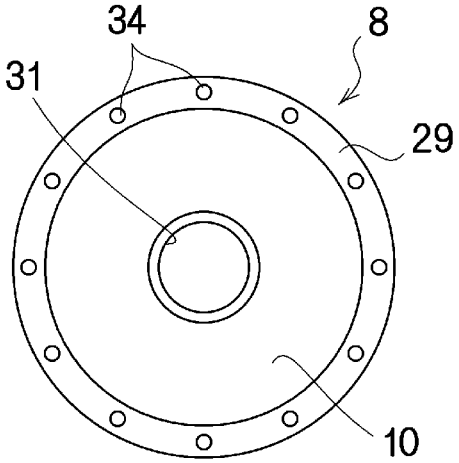
FIGS. 12A and 12B show Modified example 4 of an embodiment of the present invention.
Figure 12B:
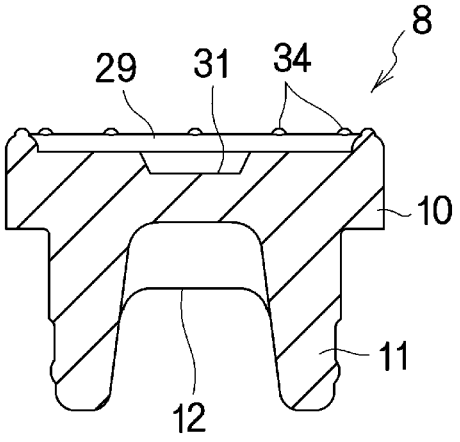

In Modified Example 4 in FIGS. 12A and 12B, the compressible projection 29 is formed into the same continuous annular ring not having any gaps as in Modified Example 3 except that, instead of the lower parts 33, projections for adhesion prevention 34 are formed on the upper surface of the compressible projection 29 in order to prevent the seal member 8 from adhering to other things. The space around the projections for adhesion prevention 34 allows the space surrounded by the compressible projection 29 to communicate with the outside.

Figure 13A:
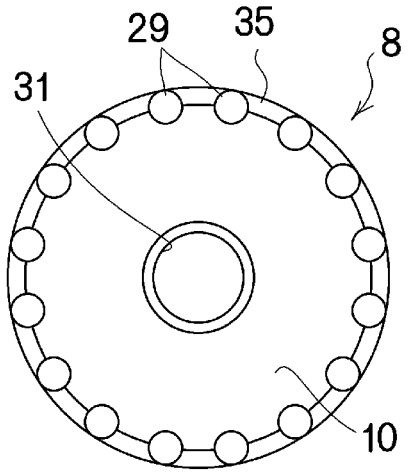
FIGS. 13A and 13B show Modified example 5 of an embodiment of the present invention.
Figure 13B:
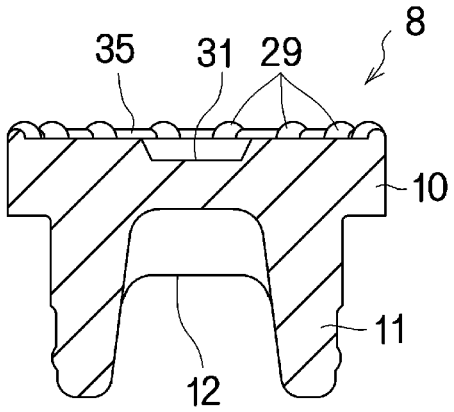

In Modified Example 5 in FIGS. 13A and 13B, the compressible projection 29 is formed into dots that are annularly disposed in a planar view. The compressible projections 29 are connected to each other by an annular portion 35, which is positioned under the compressible projections 29.

Figure 14A:
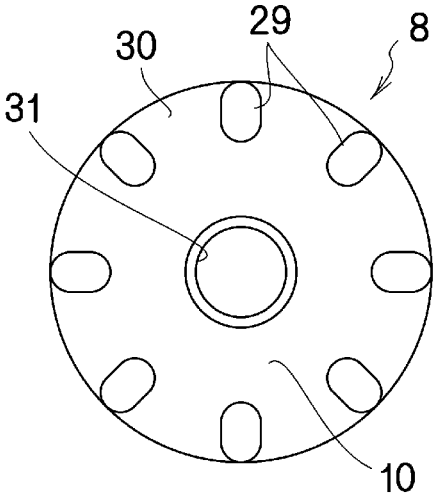
FIGS. 14A and 14B show Modified example 6 of an embodiment of the present invention.
Figure 14B:
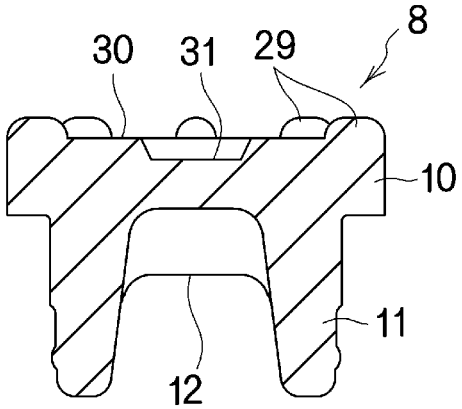

In Modified Example 6 in FIGS. 14A and 14B, a plurality of the compressible projections 29 are formed along the outer circumference of the flange 10. The compressible projections 29 are each formed into an oval body that extends radially inward in a planar view. When the compressible projections 29 are pressed down by the top wall of the cap, the flange 10 under the compressible projections 29 is extensively pressed against the upper surface of the vial 2.

In the above embodiments and Modified Examples, the seal member 8 has the depression for needle insertion 31 in the center of the upper surface of the flange 10. In the present invention, however, the depression for needle insertion 31 may be omitted, and a needle insertion site 36 having the same thickness as the thickness t of the flange 10 may be provided in the center of the upper surface of the flange 10. Examples of the needle insertion site 36 are shown in Modified Example 7 in FIGS. 15A and 15B and Modified Example 8 in FIGS. 16A and 16B.

Figure 15A:
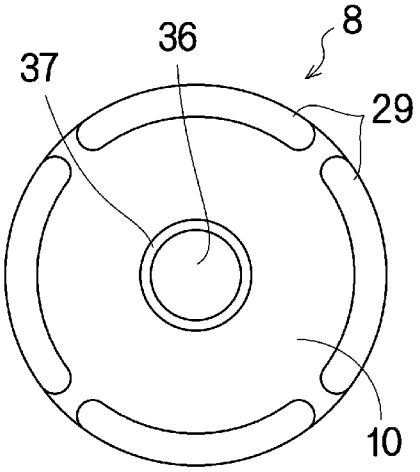
FIGS. 15A and 15B show Modified example 7 of an embodiment of the present invention.
Figure 15B:
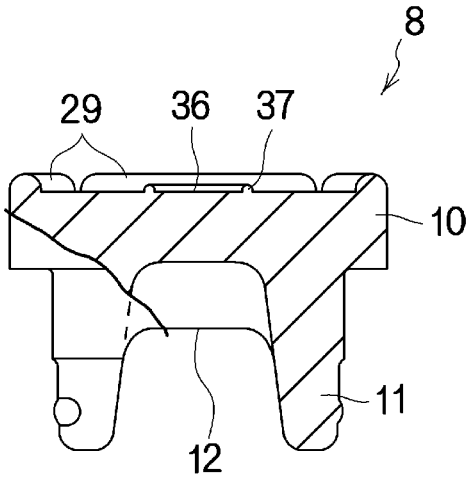

In Modified Example 7 in FIGS. 15A and 15B, as described in the above embodiments, the seal member 8 has four compressible projections 29 that is arranged along the outer circumference of the upper surface of the flange 10. Unlike the above embodiments, the center of the upper surface of the flange 10 has no depression for needle insertion but has the needle insertion site 36 that has the same thickness as the thickness t of the flange 10 and is surrounded by an annular ridge 37. The annular ridge 37 is formed into an annular ring not having any gaps. The projection height of the annular ridge 37 is lower than that of the compressible projection 29, and therefore there is no risk that the annular ridge 37 would be in contact with or adhere by suction to other things during processing such as handling, washing, and sterilization.

The other structures and their functions are the same as those of the above embodiments, and the explanations for them are omitted accordingly.

Figure 16A:
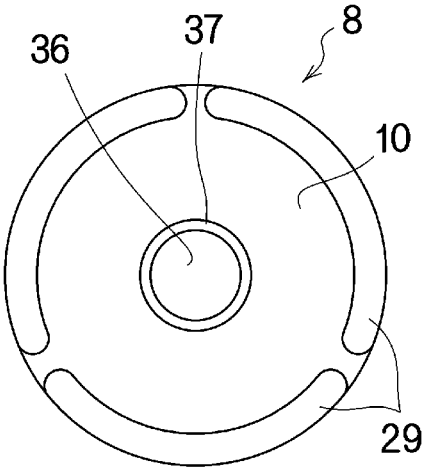
FIGS. 16A and 16B show Modified example 8 of an embodiment of the present invention.
Figure 16B:
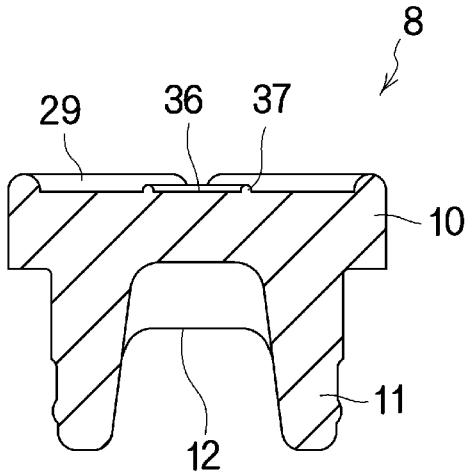
Figure 17A:
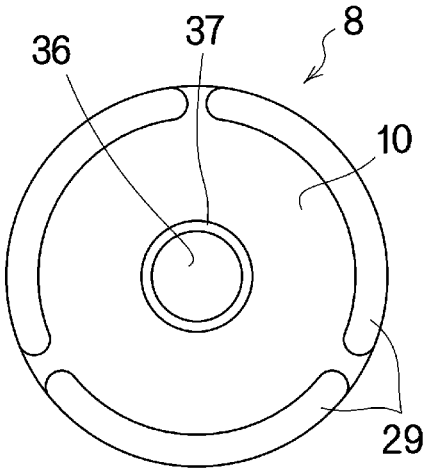
FIGS. 17A and 17B show Modified example 9 of an embodiment of the present invention.
Figure 17B:
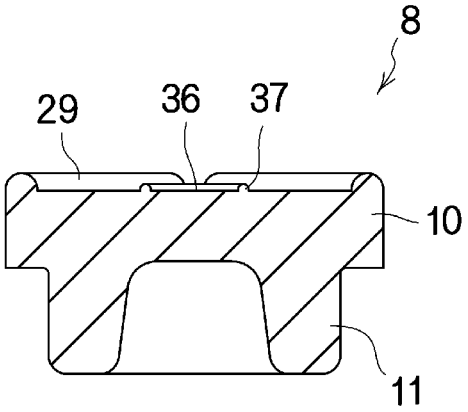

In Modified Example 8 shown in FIGS. 16A and 16B, three compressible projections 29 are arranged along the outer circumference of the upper surface of the flange 10. The other structures and their functions are the same as those of Modified Example 7, and the explanations for them are omitted accordingly.

The above embodiments and Modified Examples explain only the closure device used for a vial that contains a lyophilized preparation and the seal member for such a closure device. However, the closure device of the present invention can also be attached to a container for containing a powder preparation, a liquid preparation, or the like. In this case, attachment in the incompletely sealing state is not required: after desired contents are put in the container, the closure device only has to be attached to the opening in the sealing state. For this purpose, the leg 11 of the seal member 8 is formed into a shorter cylinder as shown in, for example, Modified Example 9 in FIGS. 17A and 17B. The notch 12 provided in the above embodiments and Modified Examples is omitted from the leg 11 in Modified Example 9. The other structures and their functions are the same as those of Modified Example 8, and the explanations for them are omitted accordingly.

The closure devices explained in the above embodiments and Modified Examples are only examples for demonstrating the technical idea of the present invention. The shape, size, material, and the like of each part are not limited to the embodiments or Modified Examples, and can be variously modified within the scope of the claims of the present invention.

For example, the above embodiments are preferable in that the combination of the compressible projection on the seal member and the receiving projection on the top wall of the cap enables the seal member to seal the opening and to suitably keep the sealing state. In the present invention, however, when the receiving projection is provided, the compressible projection is not limited to the above embodiments or Modified Examples. The compressible projection may be any other projection that also has another use, for example, a projection that prevents adhesion to other things during handling. The compressible projection may be positioned radially inward relative to the outer circumference of the flange as long as the compressible projection is positioned radially outward relative to the receiving projection. In the present invention, either of the compressible projection and the receiving projection may be omitted.

In the above embodiments, the locking part is formed on the locking member, which is a different member from the cylinder part. In the present invention, however, the locking part may be integrated into the cylinder part. Further, the cylinder part may have a slit or a vent that connects the storage part of the vial to the outside.

In the above embodiments, the window for needle entry that is provided in the top wall of the cap body is covered with the lid, and the lid is removed by breaking the joining projection. This structure enables an opened vial to be easily distinguished from an unopened vial. In the present invention, however, the lid may be omitted and the window for needle entry may be covered with, for example, a closure film that is unable to be re-sealed, or the like.

In the above embodiments, a synthetic rubber material such as a butyl rubber is used for the seal member. In the present invention, however, the seal member may be made of a material whose main raw material is another synthetic rubber, a thermoplastic elastomer, or the like. In the above embodiments, explanations are made for cases where the content is lyophilized. However, other kinds of contents such as a powder preparation and a liquid preparation may be contained in the vial for the present invention without being lyophilized. In addition, the inside of the vial may be at positive pressure, besides in vacuo or at reduced pressure, and also may be filled up with an inert gas such as nitrogen gas. Needless to say, the sectional shape, size, or the like of the receiving projection and the compressible projection is not limited to the above embodiments.

The invention claimed is:

1. A closure device for a container, which seals an opening that opens at the top of a container and has a rim on its periphery, comprising:

a seal member that covers the opening and which has rubber elasticity, said seal member including a flange that is mounted on the upper surface of the rim, said flange containing a compressible projection that projects upwardly from the upper surface of the flange and is annularly arranged in contact with and disposed along an outer circumference of the flange in planar view; and a lid member connected to a cap body and adapted to press and thereby hold the seal member on the upper surface of the rim, said cap body containing a top wall and a cylinder part that extends down from the outer circumference of the top wall, and an annular locking member disposed along the inner surface of the cylinder part and containing a locking part that engages and locks with an under surface of the rim when the lid is pushed down, said annular locking member further provided with longitudinally disposed stabilizers, whereby a diameter of a virtual circle that passes through the inner edges of each stabilizer is set at about the same as the outer diameter of the rim, or slightly smaller than the outer diameter of the rim, and wherein the cap body further contains a receiving projection which projects downward from an annular part on the under side surface of the top wall, said annular part having an inner diameter that is larger than that of the opening and an outer diameter that is smaller than that of the flange of the seal member; and wherein at least part of the compressible projection is positioned radially outward relative to the receiving projection.

2. The closure device for a container according to claim 1, wherein the compressible projection is formed into a discontinuous annular ring that is arranged along the outer circumference of the flange.

3. The closure device for a container according to claim 2, wherein a plurality of the compressible projections are arranged along the outer circumference of the flange and extend radially inward from the outer circumference of the flange.

4. The closure device for a container according to claim 1, wherein the receiving projection is an annular ring that surrounds the opening in planar view.

5. The closure device for a container according to claim 1, wherein the height (h) of the compressible projection is 10 to 60% of the thickness (t) of the flange, excluding the compressible projection.

6. The closure device for a container according to claim 1, wherein the seal member is made of at least one of a synthetic rubber material and a thermoplastic elastomer.

7. The closure device for a container according to claim 1, wherein the content of the container is a lyophilized preparation, a powder preparation, or a liquid preparation.

8. The closure device for a container according to claim 1, wherein, in a vertical section that passes through the center axis of the opening, the lower edge of the receiving projection has an angle of 90 degrees or less.

9. The closure device for a container according to claim 1, wherein, in a vertical section that passes through the center axis of the opening, the receiving projection has a sharp angle ($\alpha$) of 45 degrees or less between the surface facing radially outward and a vertical line.

10. The closure device for a container according to claim 1, wherein the height (L) of the receiving projection is 0.3 to 2.0 mm.

11. The closure device of claim 1, wherein the annular locking member comprises a plurality of annular locking parts which contain ventilation openings disposed therebetween, said stabilizers extending into said ventilation openings.

12. The closure device of claim 1, wherein the annular locking member is hinged to extend inwardly above the upper surface of the rim, when the closure device is in an incomplete sealing state, and extend inwardly below an undersurface of the rim, when the closure device is in a sealing state.

13. The closure device of claim 12, wherein the undersurface of the rim is an inclined flat surface enabling an adjustable locking engagement with the hinged locking member.

14. A closure device for closing a container provided with a peripheral rim which comprises an elastic seal member having an annular flange which is adapted to engage with the upper surface of the peripheral rim of the container, and a leg member which is adapted to extend into the container, said flange containing a peripheral compressible projection which extends from the upper peripheral surface of the annular flange, and a cap member having a top wall and a cylindrical part as sidewalls adapted to press and hold the seal member to the upper surface of the peripheral rim of the container, said top wall containing a receiving projection which extends downwardly from an inner surface of the top wall of the cap member, whereby at least part of the compressible projection is positioned radially outward, relative to the receiving projection, the side walls of the cylindrical part containing annular locking members disposed along the inner surface of the cylindrical part of the side walls, and adapted to engage the underside of the peripheral rim when the cap member is compressed downwardly to lock the closure device to the container, said annular locking member containing longitudinally provided stabilizers, whereby a diameter of a virtual circle that passes through the inner edges of each stabilizer is set at about the same as the outer diameter of the rim or slightly smaller than the outer diameter of the rim.

15. The closure device of claim 14, wherein the compressible projection is discontinuous.

16. The closure device of claim 15, wherein the compressible projection extends radially inward from the outer circumference of the flange.

* * * * *